US005860894A

United States Patent [19]

Dalebout et al.

[11] Patent Number: 5,860,894

[45] **Date of Patent: *Jan. 19, 1999**

[54] AEROBIC AND ANAEROBIC EXERCISE MACHINE

[75] Inventors: William T. Dalebout; Scott R. Watterson, both of Logan, Utah

[73] Assignee: Icon Health & Fitness, Inc., Logan, Utah

[ * ] Notice: The term of this patent shall not extend beyond the expiration date of Pat. No. 5,527,245.

[21] Appl. No.: 644,050

[22] Filed: May 9, 1996

Related U.S. Application Data

[63] Continuation of Ser. No. 190,941, Feb. 3, 1994, Pat. No. 5,527,245.

[51] Int. Cl.[6] ..... A63B 22/02

[52] U.S. Cl. ..... 482/54; 422/138; 422/133

[58] Field of Search ..... 482/54, 51, 52, 482/53, 70, 72, 73, 99, 102, 103, 137, 138

[56] References Cited

U.S. PATENT DOCUMENTS

| | | | |
|---|---|---|---|
| 4,564,193 | 1/1986 | Stewart | 482/54 |
| 4,869,493 | 9/1989 | Johnston | 482/54 |
| 5,000,440 | 3/1991 | Lynch | 482/54 |
| 5,226,866 | 7/1993 | Engel et al. | 482/54 |

*Primary Examiner*—Lynne A. Reichard
*Attorney, Agent, or Firm*—Trask, Britt & Rossa

[57] ABSTRACT

An aerobic and anaerobic treadmill exercise system including a treadmill apparatus, independent upper body exercise apparatus and independent lower body exercise apparatus.

16 Claims, 9 Drawing Sheets

AEROBIC AND ANAEROBIC EXERCISE MACHINE

This application is a continuation of pending prior application Ser. No. 08/190,941, filed on Feb. 3, 1994, of William T. Dalebout and Scott R. Watterson, entitled Aerobic and Anaerobic Exercise Machine, now U.S. Pat. No. 5,527,245.

BACKGROUND OF THE INVENTION

1. Field of the Invention:

This invention relates to exercise machines, and, more particularly, to machines for performing both aerobic and anaerobic exercises.

2. State of the Art:

One goal of exercise is to enhance the strength and endurance of skeletal muscles. Another goal is to enhance the capacity and endurance of, for example, the heart and lungs.

Exercises are sometimes categorized according to their relative purpose or effectiveness in achieving a particular goal. For purposes of this application, those exercises most effective in strengthening skeletal muscles may be termed anaerobic or strength-conditioning exercises. Strength-conditioning exercises are also sometimes called weight-training exercises. Those which are most effective in enhancing cardiovascular performance or the condition of the heart and lungs may be termed aerobic exercises. It is usually desirable to include both aerobic and anaerobic exercises in an exercise program.

Aerobic exercises rely generally on rapid and extended repetitions of an exercise movement against low to moderate resistance. Running and jogging are examples of what are typically regarded as aerobic exercises. Treadmills and stepper-type machines are examples of machines for performing running, stepping or jogging-type exercised. United States Patents disclosing stepper-type exercise machines include U.S. Pat. No. 4,838,543 (Armstrong); U.S. Pat. No. 4,830,362 (Bull); U.S. Pat. No. 4,708,338 (Potts); and U.S. Pat. No. 4,909,504 (Yang).

Anaerobic exercises for muscle conditioning are usually performed by making a relatively few repetitive movements or repetitions (e.g., 10–30) against high resistance. Typically, anaerobic exercises involve a more static type of exercise in which the user pushes or pulls against a force which can be selected or adjusted consistent with the user's desires. For example, the exerciser may work against gravitational resistance by lifting free weights, or by lifting weights through an arrangement of pulleys, to develop increased strength. Weight machines are known which provide adjustable resistance for a selection of anaerobic exercises using different muscles and limbs. Such machines may include a bench portion so the user may recline to do, for example, press exercises, or sit to do, for example, leg lift exercises. Examples include the machines described in U.S. Pat. Nos. 4,809,972 (Rasmussen et al.); 4,898,381 (Gordon); 4,902,006 (Stallings); 4,861,025 (Rockwell); 4,799,671 (Hoggan et al.); 4,930,768 (Lapcevic); 4,919,419 (Houston); 4,915,379 (Sapp); 4,900,018 (Ish et al.); and 4,915,377, 4,744,559 and 4,678,185 (Mahnke).

For many users, a home exercise apparatus greatly facilitates the regular performance of an exercise program. It is, furthermore, highly desirable to have a single machine useful for both anaerobic and aerobic conditioning. Exercise machines that combine both aerobic and anaerobic exercise functions are known. For example, U.S. Pat. No. 4,477,071

(Brown et al.) discloses a rowing machine (aerobic) which can be reconfigured and used for performing anaerobic exercises. U.S. Pat. Nos. 4,796,881 and 4,750,736 (Watterson) both disclose a rowing exerciser with a weight bench structure for anaerobic or strength exercises. U.S. Pat. No. 4,705,267 (Jackson) discloses a machine having a weight bench portion, a bicycle wind trainer and a rowing machine. In an early exercise device illustrated in U.S. Pat. No. 881,521 (Wilson), a mechanical chair was adapted to convert into a variety of exercise devices, such as an inclined roller section, rowing machine and handle exercise assembly. Commercially known machines include the GYMPAC 1500 made by Diversified Products Corporation of Opelika, Ala. and the FLEX CTS and FLEX PLUS machines made by Proform Fitness Products, Inc. of Logan, Utah.

A wide variety of anaerobic machines have been devised. For example, U.S. Pat. No. 4,072,309 (Wilson) shows a machine which can be reconfigured to perform a number of different exercises. One form of this machine is available from SOLOFLEX of Hillsboro, Oreg. It has a grip or bar element adjustably mountable in height to a central post. The bar element is mountable to a fin which extends from the central post. The fin has adjustment holes for passage of a locking pin. The bar element must be repositioned or reconfigured to perform many of the different exercises. Further, the user's hair, clothing, or digits may become entangled in the operating structure of the SOLOFLEX device.

Even though machines are known that can be reconfigured for use for both aerobic and anaerobic exercises, such machines have not in the past involved a relatively small or compact structure that can be easily converted while readily useful for aerobic exercises such as walking or jogging.

Motorized treadmills are a recognized machine for performing aerobic exercise. Various improvements to treadmills have been made to enhance their utility and their appeal, including inclination and speed adjustments, programmed and programmable exercise routines, shock absorption, pulse monitoring and safety switches.

U.S. Pat. No. 4,625,962 (Street) illustrates one such treadmill. It shows a treadmill with a cable pull apparatus to exercise the upper body and apparatus to develop muscles used in ski poling, canoeing or kayaking, and rowing.

Further, illustrated in U.S. Pat. No. 4,869,493 (Johnston) is a conventional treadmill apparatus which includes an auxiliary upper body exercise unit and a seat which, in turn, may be installed on the treadmill in a forwardly-facing or rearwardly-facing fashion to be used in conjunction with the auxiliary upper body exercise unit.

Another treadmill apparatus is illustrated in U.S. Pat. No. 5,000,440 (Lynch), which combines a treadmill with an upper body muscle-stressing device. The user may use the treadmill independently of an exerciser which utilizes weights, lifted by the user.

A similar apparatus is illustrated in U.S. Pat. No. 5,104,119 (Lynch), which combines a treadmill with an upper body exercise device and monitor. Rather than use weights in the upper body exercise device, hydraulic/pneumatic cylinders, springs, elastic bands or other suitable variable resistance means are incorporated.

In U.S. Pat. No. 5,110,117 (Fisher et al.), a treadmill is illustrated having movable handles to be grasped by the user for exercising the upper body of the user while walking on the treadmill belt. The device of the '117 patent employs spring-loaded handles pivotally mounted on each side of the treadmill belt. The handles also extend upwardly through the side surfaces or chassis adjacent the treadmill belt.

A similar-type treadmill is illustrated in U.S. Pat. No. 5,207,622 (Wilkinson et al.) wherein the pivotally-mounted handles on each side of the treadmill belt incorporate adjustable resistance devices that incorporate resistance plates or disks to adjust the desired force for the user during the upper body exercises of the user.

Yet another treadmill-type exercise device is illustrated in U.S. Pat. No. 5,226,866 (Engel et al.), which includes a treadmill, slidable foot restraints to simulate cross-country skiing, reciprocating, pivotable foot paddles connected to pneumatic cylinders or resistance mechanisms to simulate stair climbing and a pivotable torso support to assist balance of a person during exercise.

Further, illustrated in U.S. patent application Ser. No. 07/954,299 filed Sep. 30, 1992, is a treadmill with upper body exercise system as currently sold by Proform Fitness Products, Inc. as the CROSS WALK® Dual Motion Cross Trainer machine.

Disclosed in the drawings and specification, the exercise arms may be mounted on the top or outside of the side rails of the treadmill. Also, the exercise arms may be connected by a cable, rope or the like through a resistance mechanism. Other configurations of exercise arms or their equivalent may include cables or ropes extending rearwardly from a resistance structure positioned forward of the tread of the treadmill. The resistance may be configured to allow the cable or ropes to be moved by the user separately or alternately against a resistance such as friction applied to a pulley or even weights.

While such prior-art devices provide a treadmill type of apparatus which may include different types of upper body exercise, such devices do not provide sufficient flexibility and opportunity for a user to have available a broad range of aerobic and anaerobic exercises in one exercise apparatus.

SUMMARY OF THE INVENTION

The aerobic and anaerobic treadmill exercise system of the present invention combines in one exercise system a wide variety of exercise apparatus to provide a wide variety of exercises for the user in one convenient system which may be readily and easily configured by the user.

The aerobic and anaerobic treadmill exercise system of the present invention includes a treadmill apparatus, independent upper body exercise apparatus, and independent lower body apparatus in a unified exercise apparatus system.

The treadmill exercise system comprises a treadmill, independently movable arms which may be used in combination either with the treadmill, for push-pull exercises, or for butterfly type exercises, leg lift and arm lift type exercise apparatus, overhead pull type exercise apparatus and lower body pull type exercise apparatus. Adjustable resistance systems in the treadmill exercise system comprise friction type for use with the independently movable arms and an adjustable cable resistance system which is interconnected to the independently movable arms and the other lift and/or pull type exercise apparatus.

BRIEF DESCRIPTION OF THE DRAWINGS

The present invention will be more fully understood by one of ordinary skill in the art when taken in conjunction with the following detailed description of the invention with the accompanying drawings, wherein.

DETAILED DESCRIPTION OF THE DRAWINGS

Figure 1:
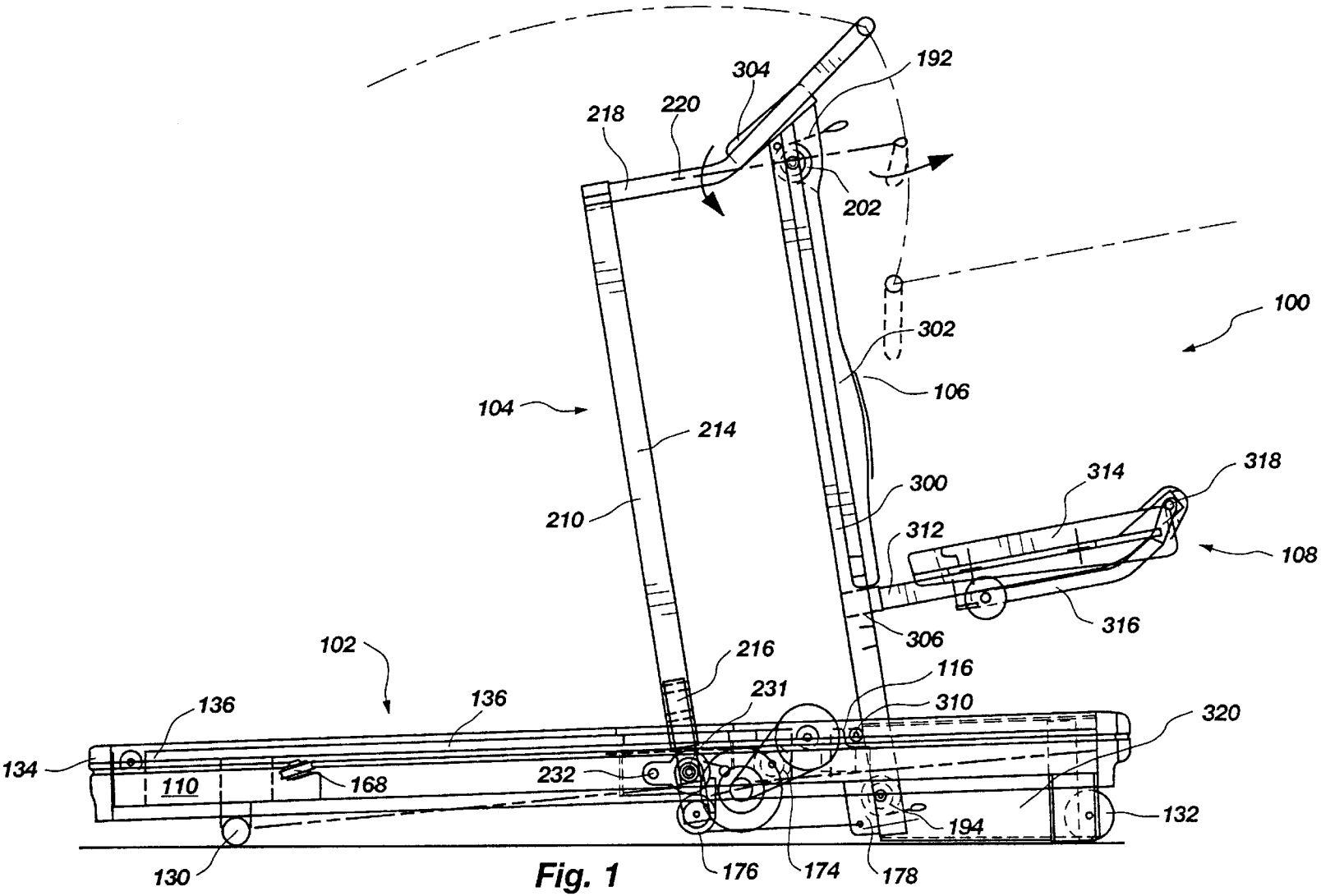
FIG. 1 is a side view of an embodiment of the present invention.

Shown in drawing FIG. 1 is a side view of an embodiment 100 of the treadmill exercise system of the present invention.

The treadmill exercise system 100 of the present invention comprises a treadmill portion 102, lever exercise arms 104, column portion 106 and movable seat portion 108.

Figure 2:
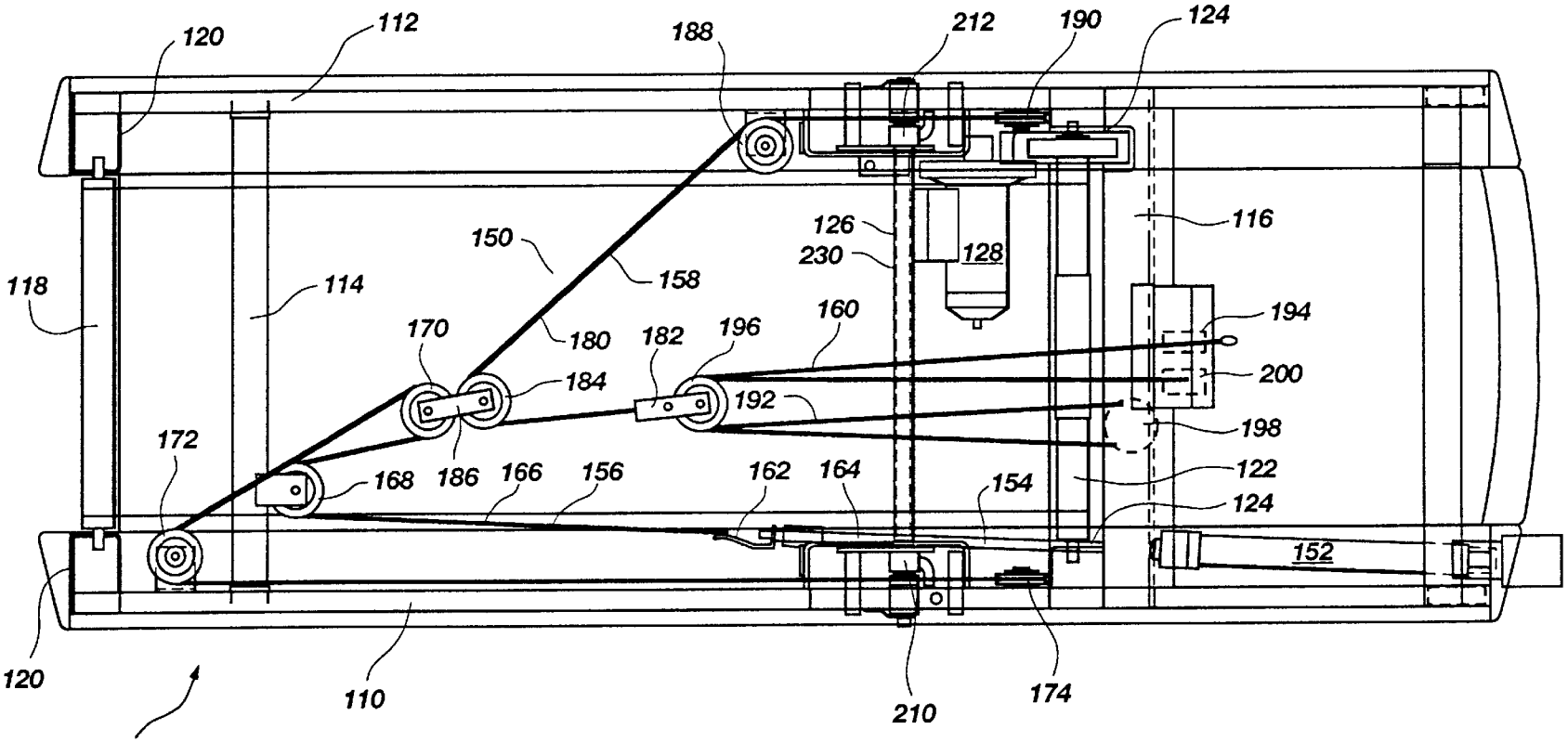
FIG. 2 is a top view of the embodiment of the present invention shown in drawing FIG. 1.

Referring to drawing FIG. 2, the aerobic exercise treadmill portion 102 includes a generally U-shaped frame having longitudinally-extending side rails 110, 112, rear cross-member 114, front cross-member 116, rear roller 118 supported by rear roller supports 120 secured to side rails 110, 112, front roller 122 supported by front roller supports 124, motor cross-member 126, and motor 128 mounted on motor cross-member 126 which drives front roller 122 via a belt (not shown) which, in turn, drives a treadmill belt (not shown).

Referring briefly to drawing FIG. 1, the treadmill exercise system 100 is supported by rear support 130 connected to side rails 110, 112 and front rollers 132 connected to side rails 110, 112. The treadmill exercise system further includes rails 134 and treadmill deck 136.

Referring again to drawing FIGS. 1 and 2, the cable resistance system 150 will be described. The cable resistance system 150 includes adjustable pneumatic hydraulic shock absorber 152, connecting rod assembly 154, first cable assembly 156, second cable assembly 158, and third cable assembly 160.

The adjustable pneumatic hydraulic shock absorber 152 may comprise any suitable multi-orifice adjustable shock absorber which may be adjusted to vary the resistance thereof. The shock absorber 152 may be gas return type or include suitable resilient return means, such as springs, elastomeric members, etc. The shock absorber 152 may be mounted in any suitable position within the system 100 for convenient adjustment of the unit. The piston of the shock absorber 152 is connected to the first cable system 156 via connecting rod assembly 154.

The connecting rod assembly 154 includes cable attachment bracket 162 secured to one end of the connecting rod 164 while the other end of the connecting rod is secured to the shock absorber 152.

The first cable assembly 156 comprises cable 166, first horizontal pulley 168 connected to rear cross-member 114, second horizontal pulley 170, third horizontal pulley 172 connected to side rail 110, first vertical pulley 174 connected to side rail 110, second vertical pulley 176 connected to the lower end of right lever arm 210, and cable bracket 178 secured to front cross-member 116. As can be readily seen, the cable 166 extends from cable attachment bracket 162, through or over the various pulleys 168, 170, 172, 174 and 176 and is secured to cable bracket 178 at the other end thereof.

The second cable assembly 158 comprises cable 180 having one end thereof secured to bracket 182, first horizontal pulley 184 secured to pulley 170 via brackets 186 extending therebetween above and below the pulleys 170 and 184, second horizontal pulley 188 connected to side rail 112, first vertical pulley 190 connected to side rail 112, a second vertical pulley (not shown) connected to the lower end of left lever arm 210, and a cable bracket (not shown) connected to front cross member 116. Again as can be readily seen, the cable 180 extends from bracket 182, through or over the various pulleys 184, 188, 190, a lever arm pulley and is secured to a cable bracket at the other end thereof.

The third cable assembly 160 comprises cable 192 having one end thereof extending from column 106 and having a suitable connector thereon, first vertical lower column pulley 194, double stacked horizontal pulley 198 connected to bracket 182, first horizontal pulley 198 connected to front cross-member 116, second vertical lower column pulley 200 connected to column 106 and vertical upper column pulley 202 connected to column 106. As can be readily seen, the cable 192 having one end thereof extending from column 106 extends under first vertical lower column pulley 194, through and over the lower pulley of double stack horizontal pulley 196, over first horizontal pulley 188, over the top pulley of the double stacked horizontal pulley 196, second vertical lower column pulley 200 through column 106, and over upper vertical column pulley 202 with the cable 192 extending from column 106 and having a suitable connector secured to the end thereof.

As is readily apparent from the foregoing, the cable assemblies 156, 158 and 160 are connected, either directly or indirectly, to each other and the adjustable pneumatic, hydraulic shock absorber 152 so that as the resistance of the shock absorber 152 is increased or decreased such will be transmitted throughout the various cable assemblies.

Although the cable resistance system 150 has been described with respect to the shock absorber 152, connecting rod assembly 154, first cable assembly 156, second cable assembly 158 and third cable assembly 160, any suitable type of system using a variable resistance and cable assemblies may be used. For instance, the shock absorber 152 may be mounted in the center of the treadmill portion 102 and two cable assemblies used, etc. A cable resistance system either as illustrated in U.S. Pat. No. 4,521,242, may be used, as illustrated in U.S. patent application Ser. No. 07/835,783, filed Feb. 14, 1992, or the equivalent thereof, which disclosures are incorporated herein by reference. Similarly, it will be readily apparent to those of ordinary skill in the art that the cable system 150 may be modified to provide any desired location of points to attach exercise apparatus thereto.

Referring to drawing FIGS. 1, 2, 3 and 5, the lever arms 104 comprise right lever arm assembly 210 and left lever arm assembly 212. As the lever arms 210 and 212 are similar in construction, only lever arm 210 will be described in detail. The lever arm 210 includes first elongated portion 214 connected to lower arm assembly 216 and universal joint assembly 218 which, in turn, is connected to L-shaped lever arm 220. The lower arm assembly 216 includes arm 222 having plate 224 secured thereto which, in turn, includes aperture 226 therethrough and L-shaped leg 228 secured thereto. The arm 222 pivots about an end of arm shaft 230, which extends between side rails 110, 112 having an end protruding therethrough to mount arm 222 thereon. Also mounted on arm shaft 230 is pulley arm 232 which serves as the member upon which first vertical pulley 176 is mounted thereon. Since arm 222 having plate 224 secured thereto is mounted on arm shaft 230, the lever arm 104 may pivot about arm shaft 230, if free to do so. Mounted between plate 224 and side rail 110 is a suitable adjustable friction plate resistance means, which is used to provide any amount of desired resistance to movement of the lever arm 104. A suitable friction plate assembly resistance means is illustrated in U.S. patent application Ser. No. 08/013,637, filed Feb. 4, 1993, which disclosure is incorporated herein by reference. The resistance of the friction plate assembly resistance means may be adjusted by rotating a knob (not shown) located on the outside of the frame rail 110. Located in frame rail 110 is a rear aperture 232, which may be aligned with aperture 226 in plate 224 secured to lower arm 222 of lever arm 104. When a pin (not shown) is inserted through aperture 226 in plate 224 and aperture 232 of frame rail 110, the lower arm 222 of lever arm 104 is prevented from rotating about arm shaft 230 thereby preventing movement of the lever arm 104. If lower arm 222 of lever arm 104 is free to pivot about arm shaft 230, the movement of lever arm 104 is resisted by the friction plate assembly between plate 224 and side rail 110 and the resistance of the cable system 150 as L-shaped leg 228 on plate 224 engages pulley arm 232 mounted on arm shaft 230 and having first vertical pulley 174 mounted thereon which, in turn, has cable 166 mounted thereover. A forward aperture 232 may be used as storage for the pin when the pin is not engaging plate 224 and side rail 110.

Figure 4:
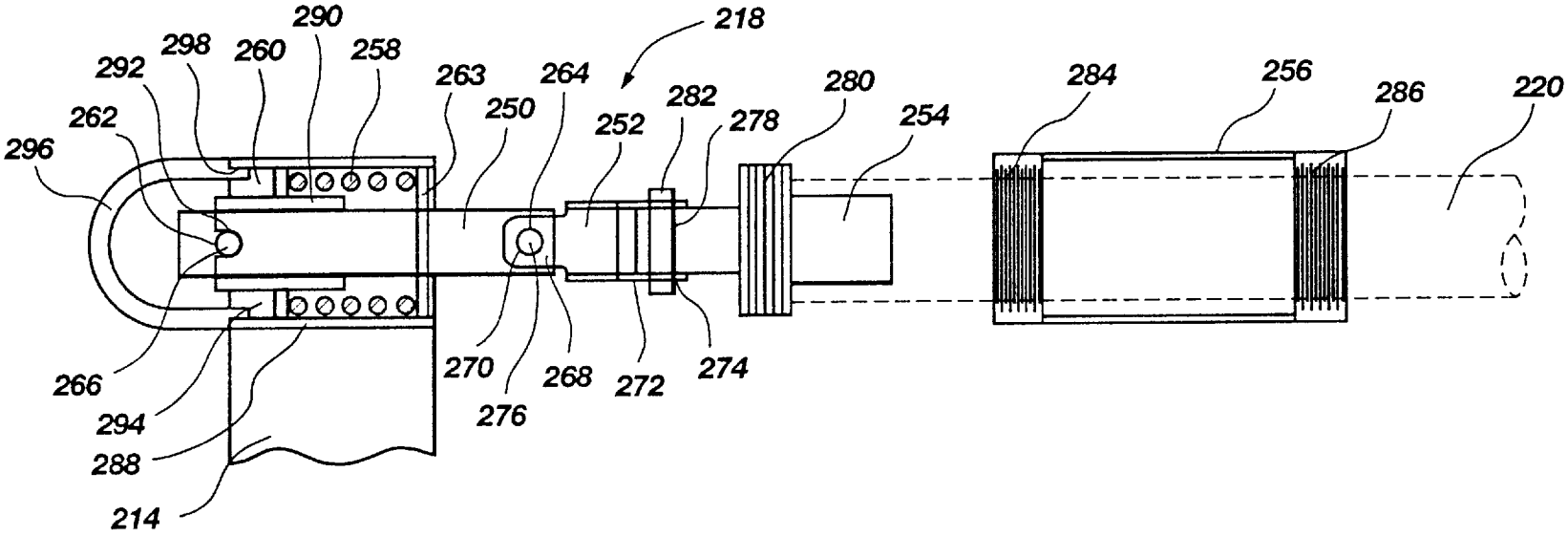
FIG. 4 is an exploded view of the universal joint and threaded collar arrangement of the embodiment of the present invention shown in drawing FIGS. 1, 2 and 3.
Figure 5:
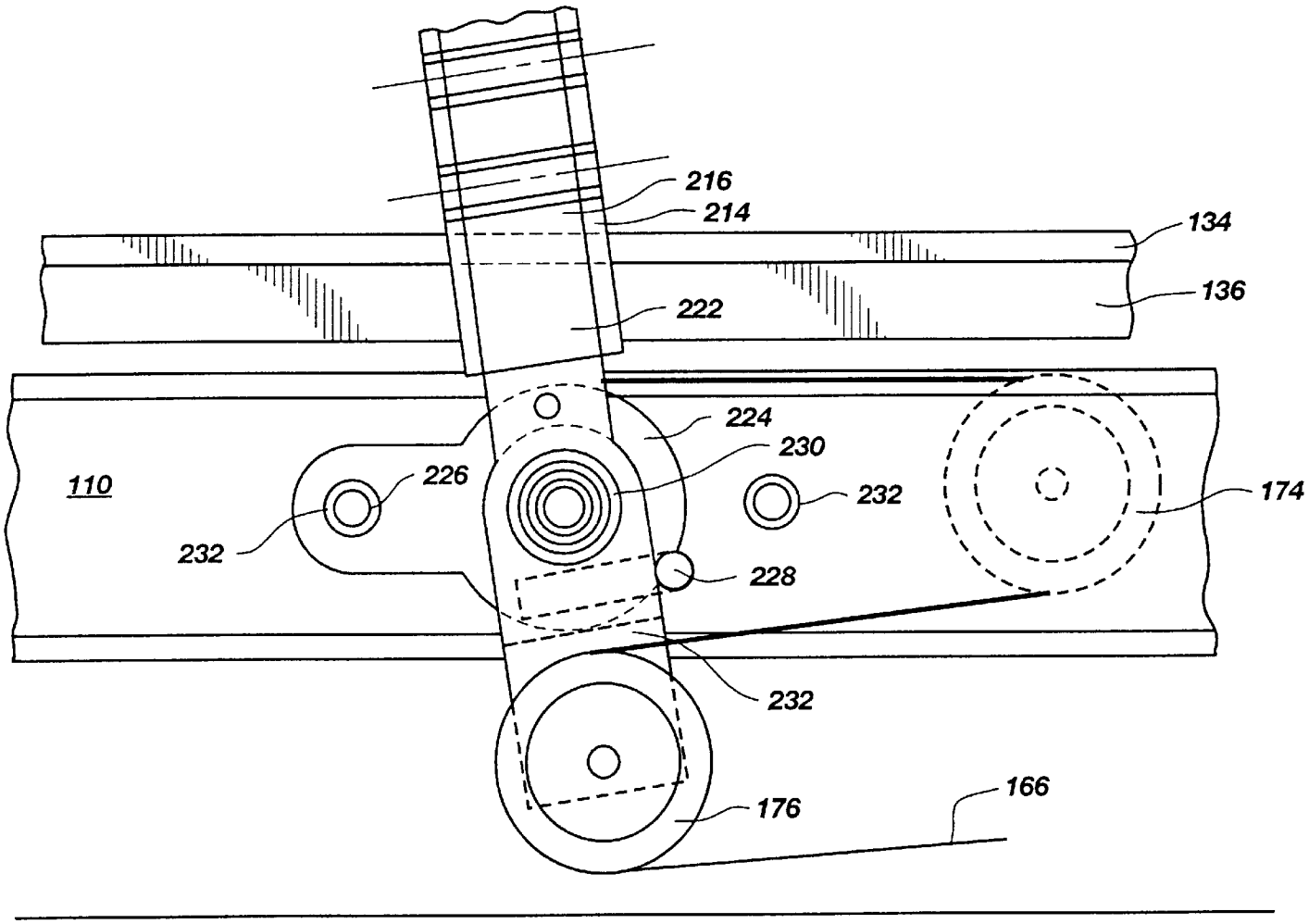
FIG. 5 is a partial view of the lower end of the lever arm of the present invention.

Referring to drawing FIG. 4, the universal joint assembly 218 is shown in an exploded view. The universal joint assembly 218 comprises first rod joint 250, second rod joint 252, third rod joint 254, joint sleeve 256, spring 258, and joint cap 260. The first rod joint 250 comprises an elongated cylindrical member having aperture 262 at one end thereof, aperture 264 at the other end thereof, annular washer 263 secured thereon and pin 266 installed in aperture 262. The second rod joint 252 comprises a cylindrical member having a first pair of two spaced apart parallel ears 268 on one end thereof, each ear having an aperture 270 therethrough, and having a second pair of two spaced apart parallel ears 272 on the other end thereof, each ear 272 having an aperture 274 therethrough, the second pair of two spaced apart parallel ears 272 being rotated ninety degrees (90°) from the first pair of two spaced apart parallel ears 268. A pin 276 extends through apertures 270 in ears 268 and through aperture 264 in first rod joint 250 securing second rod joint 252 thereto. Third rod joint 254 comprises an elongated cylindrical member having an aperture 278 through one end thereof and threaded exterior portion 280 thereon. A pin 280 extends through apertures 274 of the second pair of ears 272 of second rod joint 252 and through aperture 278 of third rod joint 254 to secure the third rod joint 254 to second rod joint 252. The joint sleeve 256 comprises an annular cylindrical member having first threaded interior portion 284 and second threaded interior portion 286. The first and second threaded interior portions 284 and 286 threadedly engage threaded portion 280 of third rod joint 254. The joint sleeve 256 slides about L-shaped arm 220, shown in phantom, which, in turn, has one end thereof connected to one end of third rod joint 254. The spring 258 comprises a suitable type coil spring mounted between annular washer 263 on first rod joint 250 and joint cap 260. The first rod joint 250 extends through aperture 288 in arm 214. The joint cap 260 comprises elongated annular cylindrical sleeve 290 having a plurality of U-shaped notches 292 in one end thereof, each notch being located ninety degrees (90°) from another, annular bushing 294 secured to a portion of the exterior of sleeve 290 and being slidable within aperture 288 of a portion of arm 214, and U-shaped member 296 having annular notch 298 located in the ends thereof being capable of engaging the exterior of portion 214 of arm 104. A portion of the first rod joint 250 is slidable through the interior of sleeve 290 having the pin 266 in one end thereof engaging notches 292 in the end of sleeve 290 with the spring 256 resiliently biasing the joint cap 260 to a portion of arm 210 and the first rod joint 250 to a portion 214 of arm 210. As can be readily seen, when interior threaded portion 284 of joint sleeve 256 engages threaded portion 280 of third rod joint 254, the first, second and third rod joints 250, 252 and 254 are free to pivot about pins 276 and 278. Additionally, by pushing first rod joint 250 inwardly (or to the left as shown) with respect to a portion 214 of arm 210 the pin 266 in the end of joint 250 may be disengaged from notches 296, the first rod joint rotated ninety degrees (90°) and the pin 266 re-engage notches 296. When the threaded interior portion 286 of joint sleeve 256 engages threaded portion 280 of the third rod joint 254, the joint sleeve 256 abuts the exterior of the portion 214 of arm 210 and pulls pin 266 tightly into notches 292 thereby preventing the first, second and third rod joints 250, 252, and 254 from pivoting with respect to each other and keeping the L-shaped portion 220 fixed with respect to portion 214 of arm 210.

Referring again to drawing FIG. 1, the column portion 106 includes a rectangular tube elongated member 300 having resilient covering 302 thereon, lower vertical pulley 194 mounted in one end thereof, upper vertical pulley 202 mounted in the other end thereof, and control console and associated controls 304 for the treadmill portion 102 mounted on top thereof. Rectangular tube elongated member 300 further includes a plurality of square, cross-sectional shaped tube openings 306 therein at any desired location. The column portion 106 is pivotally mounted to cross member 116 at 310 being retained upright by threaded fasteners (not shown), so that the column portion 106 may be folded downwardly for shipping and storage.

The column portion 106 may contain a suitable control system for regulating the treadmill and to supply the user with information such as disclosed in U.S. Pat. No. 5,104,120, which is incorporated herein by reference.

The movable seat portion 108 includes a square, cross-sectional shaped tube support 312 having one end thereof slidably selectively engage openings 306 of column portion 106 and having seat portion 314 connected thereto. Seat portion 304 includes leg pull exercise assembly 316 connected thereto at pivot 318 being retained in a stored position, as shown, by any suitable fastener (not shown). As shown, the movable seat portion 304 is in its position to be used as a seat for arm pulls or for leg pulls or the like by leg pull exercise assembly 316 being released from seat portion 304 and being connected via a chain or the like to the cable end extending under pulley 194.

To store the movable seat portion 108, the leg pull exercise assembly 316 is placed in its stored position, as shown, portion 108 is removed from upper opening 306 in column portion 106, and one end of tube support 312 is installed in lower opening 306 with the seat portion 314 thereby forming a flush deck portion in the front of treadmill portion 102. If desired, movable seat portion 108 may be completely removed from column portion 106 to thereby allow a bar or bar and chain (not shown) to be connected to cable end extending under pulley 194, allowing a user to stand in recess 320 in the front of column portion 106. Also, when the movable seat portion 108 is removed completely, a pull bar may be attached to cable end 192 extending over upper vertical column pulley 202, the uses may sit in recess 320 and do overhead arm pulls.

Figure 3:
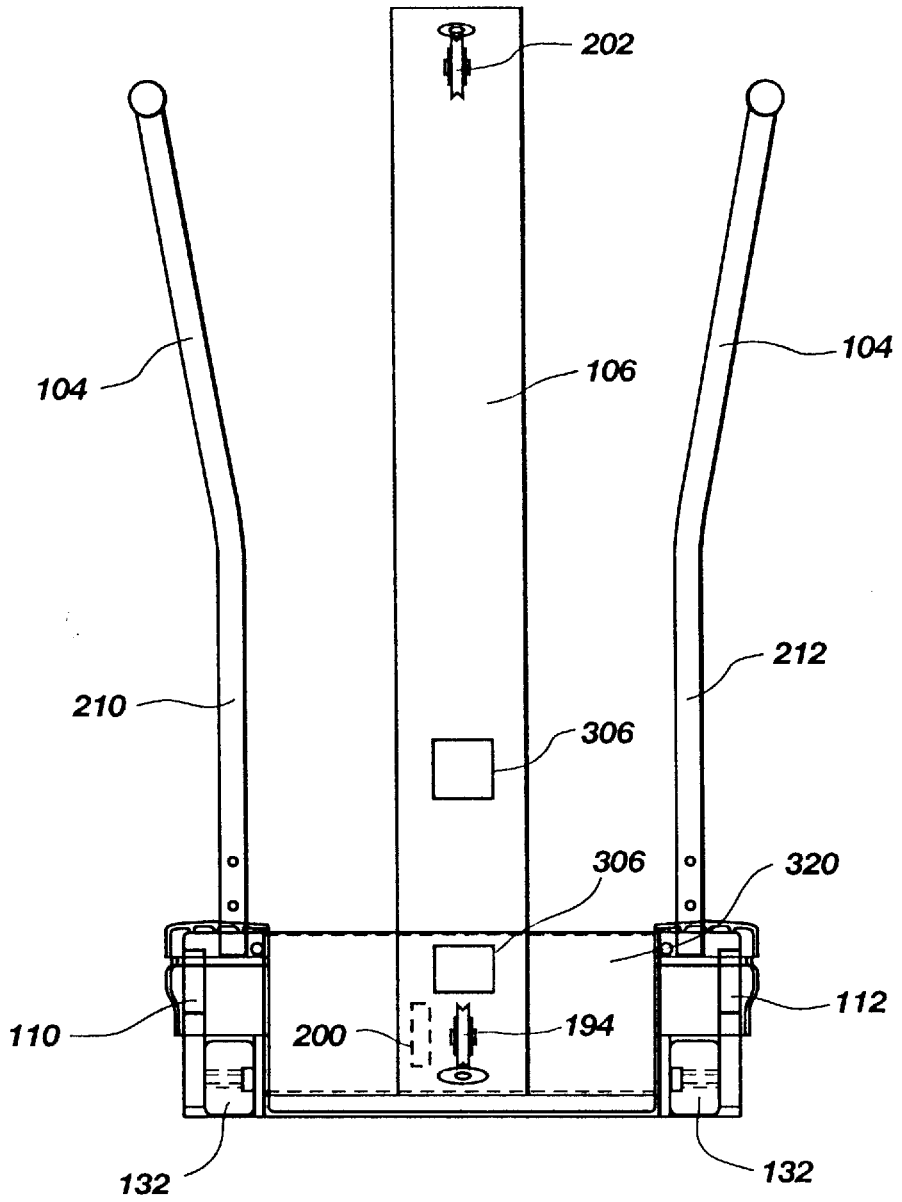
FIG. 3 is a front view of the embodiment of the present invention shown in drawing FIGS. 1 and 2.

Referring to FIG. 3 of the drawings, the column portion 106 is shown with upper pulley 202, lower pulley 194, and square tube openings 306 therein. The movable seat portion 314 has been removed to illustrate recess 320 in the front of the treadmill exercise system 100.

Figure 6:
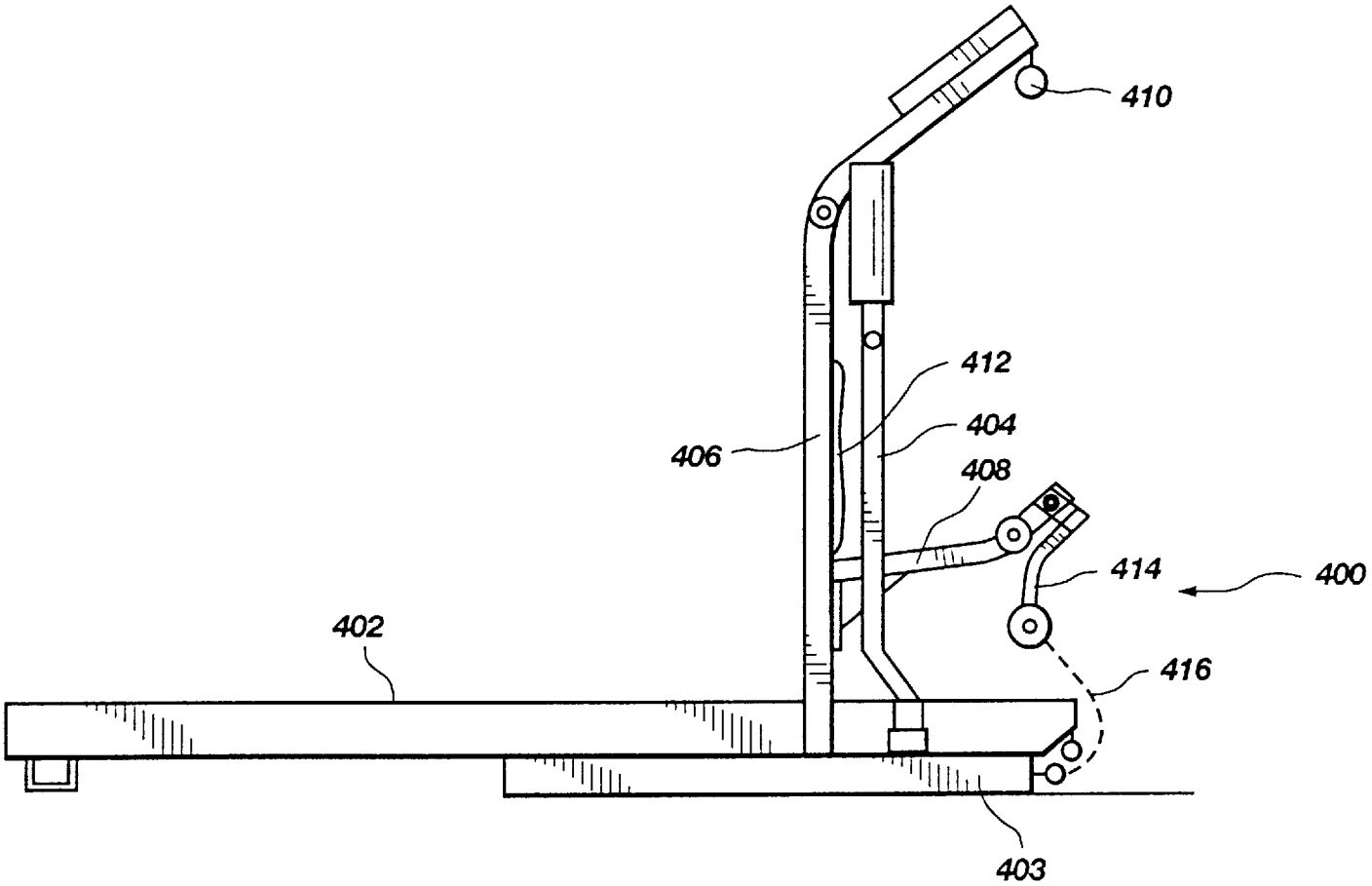
FIG. 6 is a side view of another embodiment of the present invention.

Referring to drawing FIG. 6, a second embodiment 400 of the treadmill exercise system of the present invention is shown. The treadmill exercise device 400 comprises a treadmill portion 402, lever exercise arms 404, column portion 406 and seat portion 408.

The treadmill portion 402 is constructed as generally described hereinbefore regarding treadmill exercise system 100.

The lever exercise anus 404 are connected at their lower ends via a pulley to the cable system of the column portion 406, which provides a desired resistance.

As shown, a pull bar 410 is connected to one end of a cable of the cable system in treadmill portion 402, which extends through column portion 406 extending from the upper end thereof via a pulley.

The column portion 406 further includes a resilient pad 412 thereon.

Connected to column portion 406 is seat portion 408, which includes movable leg exercise assembly 414. The assembly 414 is pivotally mounted at one end thereof on one end of seat portion 408 and is connected at the other end thereof via chain 416 to one end of a cable of the cable system in treadmill portion 402, which extends out the front of treadmill portion 402 via a pulley.

The resistance for the pull bar 410, leg exercise apparatus 414 and arms 404 may be provided by any suitable type exercise apparatus resistance system, such as illustrated in U.S. Pat. No. 4,921,242, which is incorporated herein by reference. Alternately, a cable system and resistance described in U.S. patent application Ser. No. 07/835,783, filed Feb. 14, 1992, may be installed in the column, horizontal base and/or treadmill portion to provide the necessary resistance, which application is incorporated herein by reference.

Figure 7:
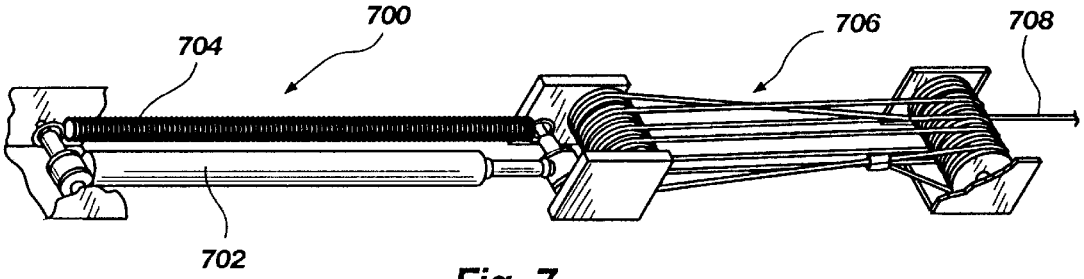
FIG. 7 is a cable resistance system for use in the embodiment of the invention illustrated in FIG. 6.
Figure 8:
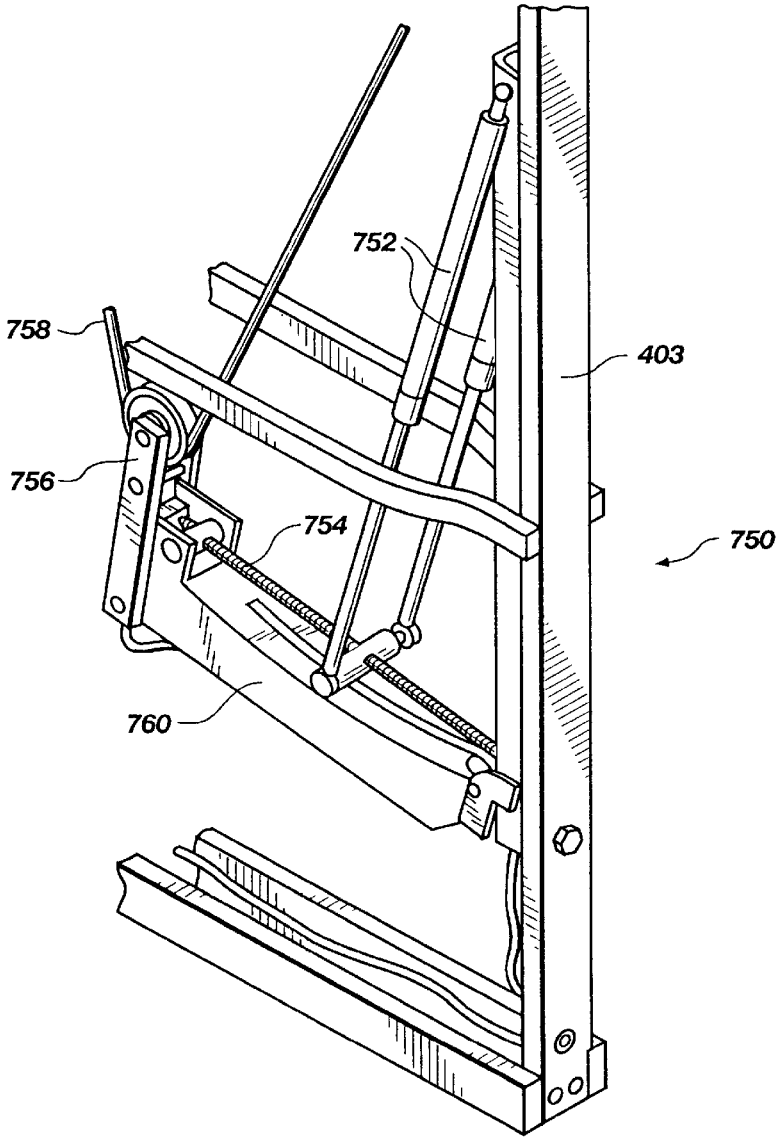
FIG. 8 is another cable resistance system for use in the embodiment of the invention illustrated in FIG. 6.

Referring to drawing FIGS. 6, 7 and 8, the treadmill exercise system 400 and suitable resistance mechanisms for use therein are illustrated. Referring to FIG. 7, a resiliently biased adjustable shock absorber cable assembly 700 comprises shock absorber 702, spring 704 and block and tackle assembly 706 having cable 708 mounted thereon. Two such assemblies 700 could be mounted in column 406 with one assembly having cable 708 connected to pull bar 410 while the other could have cable 708 connected via chain 416 to leg exercise apparatus 414. Referring to FIG. 8, alternately, the adjustable shock absorber resistance mechanism 750 could be installed in the base 403 of the system 400 for use therein. The adjustable shock absorber mechanism 750 comprises pneumatic hydraulic shock absorber 752, threaded adjustment means 754, pulley means 756, cable 758 and pivot arm 760. One end of shock absorber 752 is connected to the frame of the base 403 as well as one end of pivotable threaded member 754. Either an adjustment knob could extend through the side of base 403 or an electric motor could be connected to member 754 to rotate it remotely. By varying the lever arm of the threaded member 754 with respect to the end of shock absorber 752, the resistance to movement of pivot arm 760 may vary. The cable 758 may have its ends connected to pull bar 410 and leg exercise apparatus 414 via chain 416. In this manner, the cable resistance mechanism can be installed in base 403 rather than column 406. If desired, either mechanisms 700 and/or 750 can be installed in column 406 and/or base 403.

Figure 9:
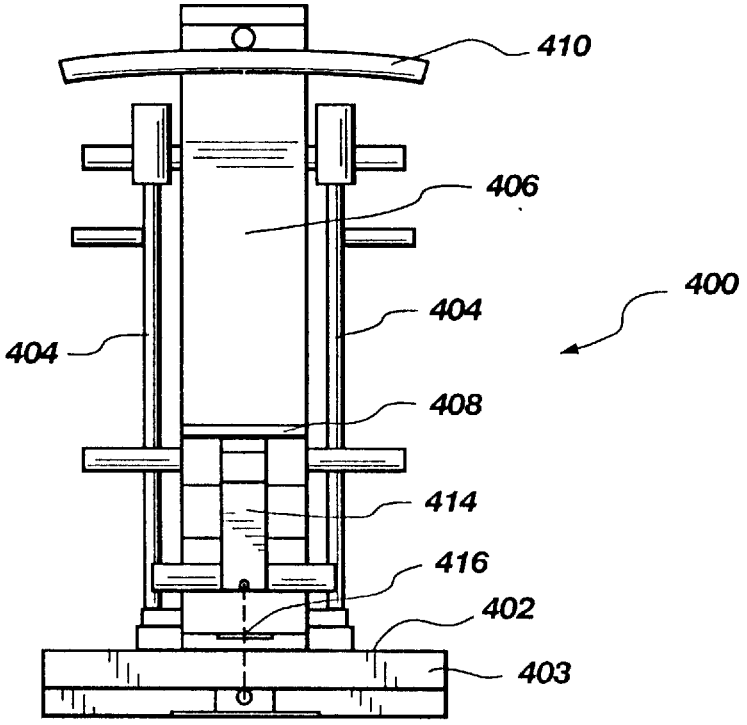
FIG. 9 is a front view of the embodiment of the present invention shown in drawing FIG. 5.

Referring to drawing FIG. 9 the treadmill exercise system 400 is shown. As illustrated, the pull bar 410 extends from the top of column 410 while the leg exercise apparatus 414 is connected via chain 416 to a cable extending from the bottom of the base 403.

Figure 10:
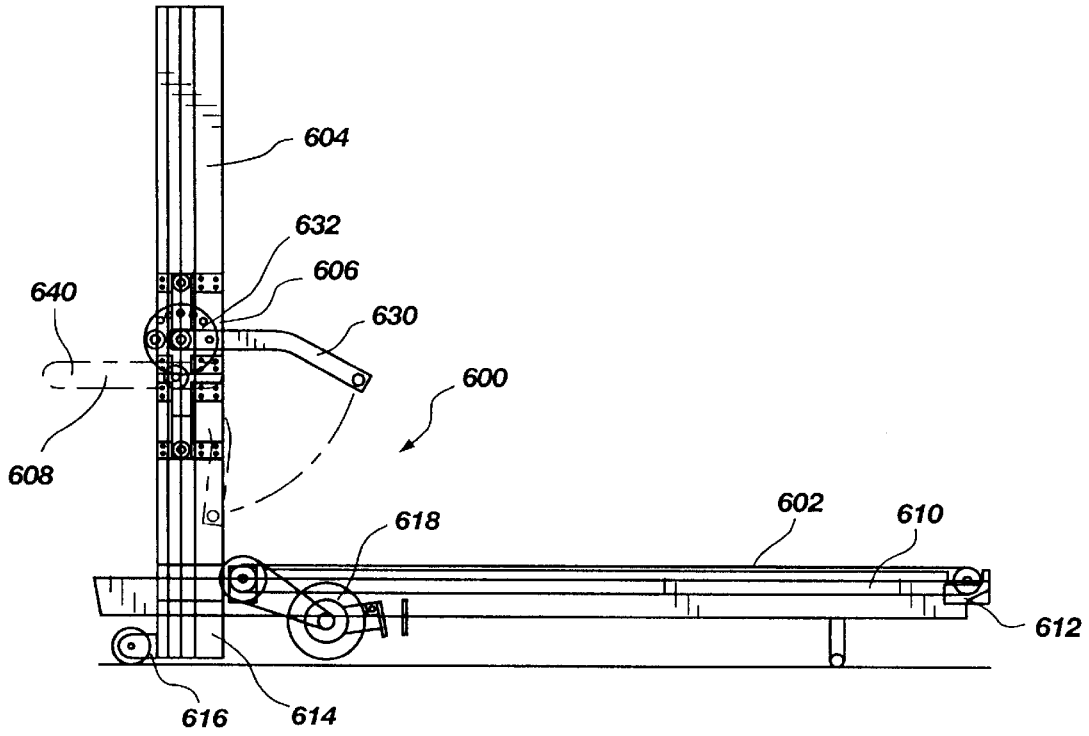
FIG. 10 is a side view of yet another embodiment of the present invention.
Figure 11:
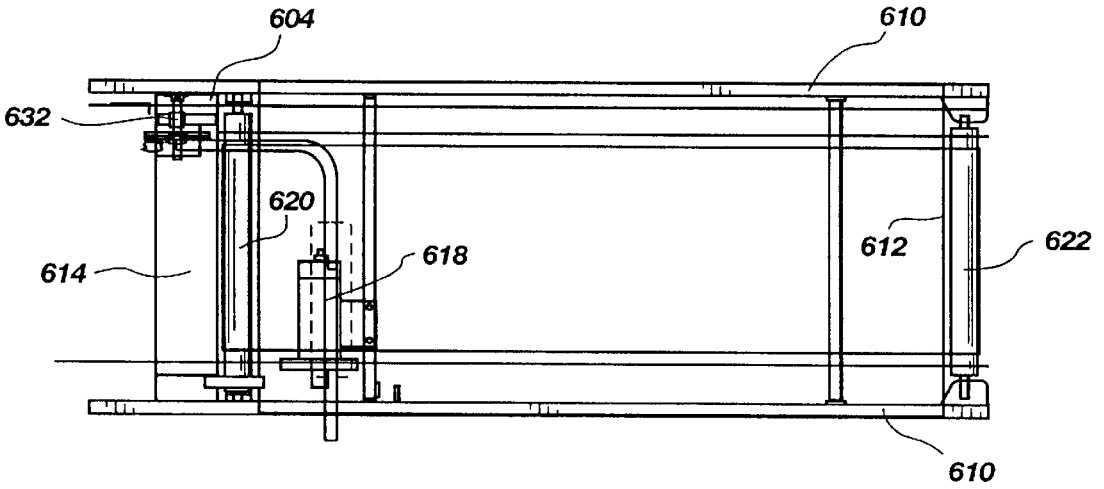
FIG. 11 is a top view of the embodiment of the invention shown in drawing FIG. 7.

Referring to FIGS. 10 and 11 another embodiment 600 of the treadmill exercise system of the present invention is shown.

The treadmill exercise system 600 comprises a treadmill portion 602, column portion 604, exercise arm assembly 606 and seat portion 608.

The treadmill portion 602 includes a generally U-shaped frame having longitudinally-extending side rails 610 having rear support 112 connected thereto, front cross member 614 therebetween, and front wheel supports 616 thereon. An electric motor 618 is provided to drive an endless treadmill belt (not shown) that extends longitudinally between front roller 620 and rear roller 622 over a treadmill deck (not shown).

The column portion 604 is a vertically-extending, elongated member being connected to the front portion of a side rail 610. The column portion 604 contains suitable controls for the operation of the treadmill portion 602.

Movably connected to column portion 604 is exercise assembly 606. The exercise arm assembly 606 includes an exercise arm 630 secured via a mounting plate having a plurality of apertures therein to a similar mounting plate attached to a variable friction plate assembly 632 which, in turn, is connected to column portion 604. The variable friction plate assembly can be of any suitable type, such as described hereinbefore, typically using an adjustable friction plate to vary the resistance. The orientation of the exercise arm 630 may be varied by securing the arm 630 via its mounting plate to the friction plate assembly 632. Also, a suitable cable-type resistance system, such as illustrated in U.S. Pat. No. 4,921,242, which disclosure is herein incorporated by reference, may be installed in column portion 604 and connected to exercise arm 630 to provide any desired amount of resistance. Such a system is generally shown in drawing FIG. 7 as hereinbefore described. Alternately, a cable-type resistance system as hereinbefore described in drawing FIG. 8 may be used with the system mounted in between the side rails 610 of the treadmill portion. Such a system is illustrated in U.S. patent application Ser. No. 07/835,783, filed Feb. 14, 1992, which is incorporated herein by reference.

The seat assembly 608 is movably, pivotally secured to column portion 604 so that the seat 640 may be moved to any desired position along the column portion 604 by the user. In this manner, a user may be seated on seat assembly 608 and use exercise arm assembly 606 to exercise the upper body or legs from a seated position. The seat assembly 608 may be pivoted downwardly with respect to the column 604, if desired by the user. The seat assembly contains any suitable locking arrangement so that when the seat 640 is in the position shown in FIG. 11 of the drawings, the user may rest thereupon to use arm 630.

The treadmill exercise system 600 includes any suitable control system and monitor for the user as may be desired such as described hereinbefore. Such control system and monitor may be located on the column 604 for ready access by a user.

OPERATION OF THE INVENTION

Referring to drawing FIGS. 1 through 5 when the arms 104 are pinned via apertures 226 in plates 224 through apertures 232 to side rails 110, 112 the arms 104 are stationary and cannot be moved or reciprocated. In this manner, the arms 104 may serve as stationary support for a user exercising on the treadmill portion 102. If the arms 104 are free to reciprocate by removing the pins in apertures 232 and 226 in side rails 110, 112 and plates 224 respectively the user of treadmill portion 102 may use the arms for reciprocating resistance-type exercise as described in CROSS-WALK® Dual Motion Cross Trainer exercise system as sold by Proform Fitness Products, Inc., Logan, Utah. The resistance of the arms may be varied by varying the resistance of the friction plate assembly by rotating knob 231 which controls the friction plate assembly on each arm 104 and by varying the resistance of the shock absorber 152 which is connected via cable system 150 to the lower end of each arm 104 via pulleys.

When L-shaped portions 220 of arms 104 are rotated and locked in position ninety degrees (90°) via universal joint assembly 218 on each arm 104 (shown in FIG. 1 in lower phantom line), a user may stand in front of the treadmill exercise system 100 and reciprocate the lever arms 104 through push-pull exercises. Similarly, when L-shaped portions 220 of arms 104 are rotated ninety degrees (90°) via universal joint assembly 218 on each arm (shown in FIG. 1 in upper phantom line) but are left in an unlocked position so that universal rod joints 250, 252 and 254 are free to pivot, a user may set on seat assembly 314, place their arms about L-shaped members 220 and perform butterfly-type exercises while reciprocating the arms 104 with the universal joint assembly 218 on each arm 104 allowing two directions or axis of movement of the L-shaped portion 220 with respect to portion 214.

When the seat assembly 314 is removed entirely from column portion 106, a pull bar (not shown) may be connected to the end of the cable extending under the lower pulley 194 of the column 106 with the user standing in recess 320 of the treadmill exercise system 100 pulling upwardly on the pull bar with the shock absorber 152 providing the resistance via cable system 150.

Alternately, the user may sit in recess 320, attach a pull bar (not shown) to the end of the cable extending over pulley 202 in the upper portion of the column 106 and perform pull exercises with the shock absorber 152 providing resistance through cable system 150.

Further with seat assembly 314 reinstalled on column 106 in the upper position 306 with a chain connected to the cable end extending from below lower pulley 194 of column 106 to the leg exercise assembly 316 the user may use the assembly 316 to do leg exercises and, alternately, when standing, the user may use assembly 316 to do arm exercises with the shock absorber 152 pivoting the resistance through cable system 150.

Alternately, the movable seat portion 108 may be installed in lower opening 306 of column portion 106 to provide an essentially smooth, continuous deck in the front portion of treadmill exercise system 100.

Referring to FIGS. 6 through 9 of the drawings, the treadmill exercise system 400 may be used as a conventional treadmill by the user. Alternately, the user may be seated on seat portion 408 connected to column portion 406 with the user's arms engaging exercise arms 404. The user's arms may be moved inwardly in a butterfly manner, thereby moving the exercise arms 404 longitudinally with the shock absorber cable system in the column 406 providing the resistance via pulleys connected to the lower end of the exercise arms 404. Also, the user may stand and use exercise arms 404 in push/pull exercises, if desired.

Further, when the user is seated on seat portion 408, the pull bar 410 may be used in the manner described hereinbefore as well as the leg exercise assembly 414 as described hereinbefore.

Referring to FIGS. 7 and 8 of the drawings, the treadmill exercise system 600 may be used as a conventional treadmill exerciser by a user engaging treadmill portion 602.

Alternately, a user may use the treadmill 602 while moving the exercise arm assembly 606 upwardly and downwardly with respect to the column portion 604. If desired, the user may extend seat assembly 608, sit thereon, and use the exercise arm assembly 606 with the user's arms or legs for any desired exercise.

It should be noted that the exercise apparatus in the treadmill exercise system of the present invention are integrated into a system that provides for a compact aerobic and anaerobic exercise system that may be readily converted into a variety of configurations by the user.

Those skilled in the art will recognize variations in the treadmill exercise system of the present invention that are within the scope of the teachings herein. The previously-described embodiments are not intended to limit the scope of the claims.

We claim:

1. A treadmill exercise system for use during aerobic and anaerobic exercise by a user, said treadmill system comprising:

a frame including a first side rail, a second side rail spaced from the first side rail, a front cross-member extending between the first side rail and second side rail, and a rear cross-member extending between the first side rail and second side rail;

a first exercise means including a longitudinally extending, movable endless belt extending between a portion of the first side rail and the second side rail providing a treadmill for the user during the aerobic exercise;

adjustable resistance means connected to a portion of the frame;

second exercise means connected to a portion of the frame for use during the aerobic and the anaerobic exercise by the user, the second exercise means being connected to said adjustable resistance means; and third exercise means including a first pivotally mounted lever arm and spaced from the longitudinally extending, movable endless belt and a second pivotally mounted lever and spaced from the longitudinally extending, movable endless belt, the second exercise means being selectively operable and connected to said adjustable resistance means, said third exercise means including:

the first pivotally mounted and second pivotally mounted lever arms for movement by the user and having adjustment means thereon for allowing the user to engage the first pivotally mounted and second pivotally mounted lever arms for performing exercise movements with the arms of the user.

2. A treadmill exercise system for use during aerobic and anaerobic exercise by a user, said treadmill system comprising:

a frame including a first side rail, a second side rail spaced from the first side rail, a front cross-member extending between the first side rail and second side rail, and a rear cross-member extending between the first side rail and second side rail;

a first exercise means including a longitudinally extending, movable endless belt extending between a portion of the first side rail and the second side rail providing a treadmill for the user during the aerobic exercise;

adjustable resistance means connected to a portion of the frame;

second exercise means connected to a portion of the frame for use during the aerobic and the anaerobic exercise by the user, the second exercise means being connected to said adjustable resistance means; and leg extension exercise means for use by the user.

3. The treadmill exercise system of claim 1 further including:

leg extension exercise means pivotally connected to a portion of a forward-facing seat means for use by the user when the user is engaging a portion of the forward-facing seat means.

4. The treadmill exercise system of claim 1, wherein the first and second lever arms are pivotally mounted to rotate about a common axis.

5. A treadmill exercise system for use during aerobic and anaerobic exercise by a user, said treadmill system comprising:

a frame including a first side rail, a second side rail spaced from the first side rail, a front cross-member extending between the first side rail and second side rail, and a rear cross-member extending between the first side rail and second side rail;

a first exercise means including a longitudinally extending, movable endless belt extending between a portion of the first side rail and the second side rail providing a treadmill for the user during the aerobic exercise;

adjustable resistance means connected to a portion of the frame;

second exercise means connected to a portion of the frame for use during the aerobic and the anaerobic exercise by the user, the second exercise means being connected to said adjustable resistance means; and third exercise means including a first pivotally mounted lever arm and spaced from the longitudinally extending, movable endless belt and a second pivotally mounted lever and spaced from the longitudinally extending, movable endless belt, the second exercise means being selectively operable and connected to the adjustable resistance means, the first and second lever arms being pivotally mounted to rotate about a common axis wherein the common axis for the first and second lever arms is proximate the center of the treadmill frame.

6. The treadmill exercise system of claim 4, wherein the resistance means resists movement of the first and second lever in both a frontward direction and rearward direction of movement.

7. The treadmill exercise system of claim 4, wherein the first and second lever arms are mounted on opposite sides of the treadmill frame.

8. The treadmill exercise system of claim 1, wherein the first and the second lever arms for movement by the user further comprise:

the first lever arm including a first portion connected to the resistance means and a second portion connected to the first portion, the second portion being movably connected to the first portion for the user to orient the second portion with respect to the first portion to provide different configuration of shapes for the first lever arm for the user during the exercise; and the second lever arm including a first portion connected to the resistance means and a second portion connected to the first portion, the second portion being movable connected to the first portion for the user to orient the second portion with respect to the first portion to provide different configurations of shapes of the second lever arm for the user during the exercise.

9. A treadmill exercise system for use during exercise by a user, said treadmill exercise system comprising:

a treadmill frame with spaced side surfaces, each surface having a middle area, the treadmill frame supporting a longitudinally extending movable endless belt between said side surfaces;

an upwardly extending column means disposed forwardly of the endless belt;

lever arm means for movement by the user, the lever arm means being mounted on said spaced side surfaces of said treadmill frame and being connected to the column means;

resistance means connected to a portion of the column means to resist movement of the lever arm means by the user; and seat means connected to a portion of the column means to provide a seat for the user during portion of the exercise, the lever arm means being movable by the user when the user is engaging a portion of the seat means.

10. An aerobic and anaerobic exercise system for use during exercise by a user, said aerobic and anaerobic exercise system comprising:

an aerobic exercise apparatus means including a frame portion having an upwardly extending column extending upwardly adjacent on end thereof, the apparatus means for providing the aerobic exercise during said use by the user, said aerobic exercise apparatus means including:

a treadmill frame with spaced side surfaces, each surface having a middle area, the treadmill frame supporting a longitudinally extending movable endless belt between said side surfaces; and an anaerobic exercise apparatus means including portions connected to the frame of the aerobic exercise apparatus means and a portion connected to the column extending upwardly adjacent on end of the frame of the aerobic exercise apparatus means, the anaerobic exercise apparatus means for providing the anaerobic exercise during the use by the user in at least two different positions of use by the user.

11. An exercise system for use in performing aerobic and anaerobic exercise by a user, said exercise system comprising:

a frame having secured thereto moveable means to support an upright user thereon including for said use in performing the aerobic exercise;

second exercise means having moveable structure connected to a portion of the frame for the use in performing the anaerobic exercises;

third exercise means having a lever arm pivotally mounted to said frame for operation by the user on said moveable means in performing the aerobic exercise and by the user repositioned on said second user support means in performing the anaerobic exercises; and user support means connected to said exercise system to support the user proximate said second exercise means.

12. The exercise system of claim 11, wherein said second exercise means includes arm means for engagement by the user in performing exercises.

13. The exercise system of claim 11, further including an upright member connected to said frame and wherein said moveable structure is movably associated with the upright member.

14. The exercise system of claim 13, wherein said moveable structure is a lever rotatably adapted to said upright member.

15. The exercise system of claim 14, wherein said lever is connected to a base and is moveable relative thereto, said lever including means to secure said lever to said base, and wherein said base is moveable along the length of said upright member and is connected to said resistance means.

16. The exercise system of claim 11, wherein said moveable structure is a bar with an interconnecting cable means extending along said upright member for connection to said resistance means.

* * * * *